US010602263B2

(12) United States Patent
Smithers et al.

(10) Patent No.: US 10,602,263 B2
(45) Date of Patent: Mar. 24, 2020

(54) PLANAR LOUDSPEAKER MANIFOLD FOR IMPROVED SOUND DISPERSION

(71) Applicant: DOLBY LABORATORIES LICENSING CORPORATION, San Francisco, CA (US)

(72) Inventors: Michael J. Smithers, Kareela (AU); Garth Norman Showalter, Ozark, MO (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/079,300

(22) PCT Filed: Feb. 22, 2017

(86) PCT No.: PCT/US2017/018955

§ 371 (c)(1),
(2) Date: Aug. 23, 2018

(87) PCT Pub. No.: WO2017/147190

PCT Pub. Date: Aug. 31, 2017

(65) Prior Publication Data

US 2019/0052956 A1 Feb. 14, 2019

Related U.S. Application Data

(60) Provisional application No. 62/299,323, filed on Feb. 24, 2016, provisional application No. 62/354,927, filed on Jun. 27, 2016.

(51) Int. Cl.
*H04R 1/34* (2006.01)
*H04R 9/04* (2006.01)
(Continued)

(52) U.S. Cl.
CPC ..... *H04R 1/345* (2013.01); *G10K 11/02* (2013.01); *H04R 9/025* (2013.01); *H04R 9/048* (2013.01); *H04R 9/063* (2013.01)

(58) Field of Classification Search
CPC ..... H04R 9/048; H04R 1/345; H04R 9/063; G10K 11/02
See application file for complete search history.

(56) References Cited

U.S. PATENT DOCUMENTS 4,091,891 A 5/1978 Hino
5,021,613 A 6/1991 Garcia
(Continued)

FOREIGN PATENT DOCUMENTS

EP 1071308 1/2001
EP 1450348 12/2011
(Continued)

OTHER PUBLICATIONS

Takewa, H. et al., "Slim-type speaker for flat-panel televisions", IEEE Transactions on consumer electronics, Feb. 2006, vol. 52, Issue 1, pp. 189-195.

*Primary Examiner* — Sunita Joshi

(57) ABSTRACT

An acoustic manifold for altering a sound wavefront shape from a loudspeaker having a substantially planar driver, comprising a mounting surface configured to attach to a front surface of a case surrounding the driver and having two vertical openings matching corresponding vertical openings in the case to allow sound from the driver to project therethrough, and a waveguide portion coupled to the mounting surface and having a structure channeling sound projected from the driver through the two vertical openings to be combined in one output area. The structure has a plurality of reflective surfaces configured to create output sound that has a consistent dispersion pattern over a defined area. The manifold is configured to increase a vertical and/or
(Continued)

horizontal beamwidth of the projected sound so that listeners positioned off an axis of the loudspeaker will hear a wide range of audible frequencies at a substantially similar sound level.

11 Claims, 17 Drawing Sheets

(51) Int. Cl.

| | |
|---|---|
| ***G10K 11/02*** | (2006.01) |
| ***H04R 9/02*** | (2006.01) |
| ***H04R 9/06*** | (2006.01) |

(56) References Cited

U.S. PATENT DOCUMENTS

| | | | | |
|---|---|---|---|---|
| 5,163,167 | A | 11/1992 | Heil | |
| 5,283,836 | A | 2/1994 | Trufitt | |
| 5,900,593 | A | 5/1999 | Adamson | |
| 6,104,825 | A | 8/2000 | Thigpen | |
| 6,343,133 | B1 * | 1/2002 | Adamson | H04R 1/26 181/152 |
| 6,581,719 | B2 | 6/2003 | Adamson | |
| 6,593,847 | B2 | 7/2003 | Miyazaki | |
| 6,668,969 | B2 | 12/2003 | Meyer | |
| 7,174,024 | B1 | 2/2007 | Suzuki | |
| 7,316,290 | B2 | 1/2008 | Hutt | |
| 7,835,537 | B2 | 11/2010 | Cheney | |
| 7,873,178 | B2 | 1/2011 | Steere | |
| 7,903,834 | B1 | 3/2011 | Graber | |
| 8,085,969 | B2 | 12/2011 | Simidian | |
| 8,363,865 | B1 | 1/2013 | Bottum | |
| 9,111,521 | B2 | 8/2015 | Blore | |
| 2006/0169530 | A1 | 8/2006 | Noselli | |
| 2008/0006476 | A1 | 1/2008 | Kling | |

FOREIGN PATENT DOCUMENTS

| | | |
|---|---|---|
| EP | 2838083 | 2/2015 |
| WO | 2002/056293 | 7/2002 |

* cited by examiner

FIG. 1C
(PRIOR ART)
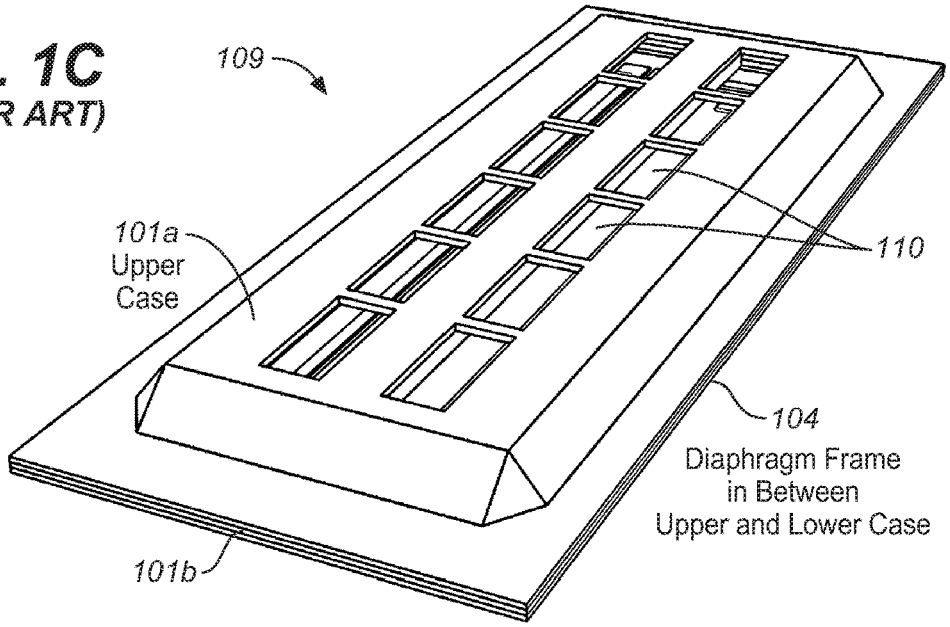
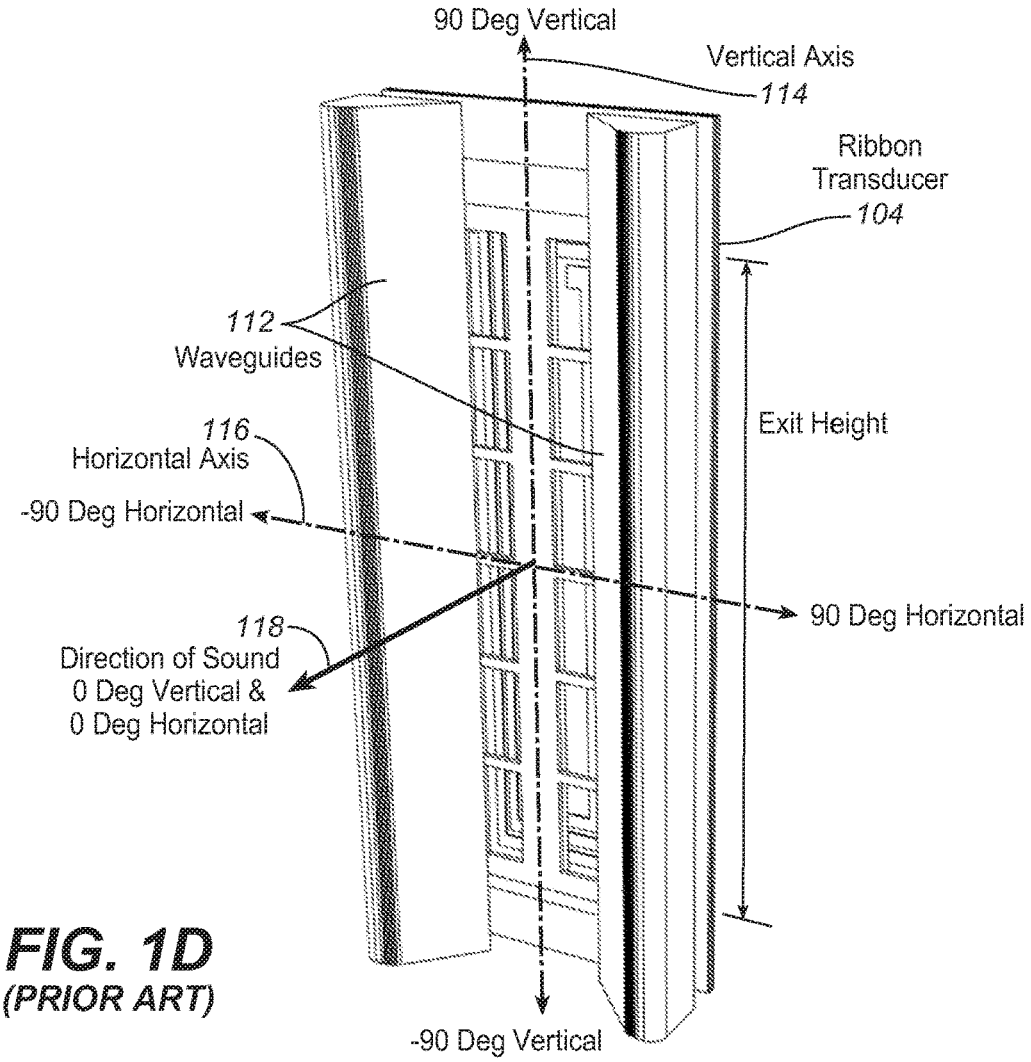
FIG. 1D
(PRIOR ART)

PLANAR LOUDSPEAKER MANIFOLD FOR IMPROVED SOUND DISPERSION

CROSS-REFERENCE TO RELATED APPLICATIONS

This application claims priority to U.S. Provisional Patent Application 62/299,323, filed on Feb. 24, 2016 and U.S. Provisional Patent Application 62/354,927 filed on Jun. 27, 2016, each of which is hereby incorporated by reference in its entirety.

FIELD OF THE INVENTION

One or more implementations relate generally to audio speakers, and more specifically to manifold structures for planar loudspeakers to improve horizontal sound dispersion effects.

BACKGROUND

As is generally known, a loudspeaker driver is a device that converts electrical energy into acoustic energy or sound waves. In its simplest form, a typical loudspeaker driver consists of a coil of wire bonded to a cone or diaphragm and suspended such that the coil is in a magnetic field and such that the coil and cone or diaphragm can move or vibrate perpendicular to the magnetic field. An electrical audio signal is applied to the coil and the suspended components vibrate proportionally and generate sound.

Although cone and horn-type speakers are very common, other types of loudspeakers, such as planar magnetic loudspeakers are also well-used. A planar magnetic loudspeaker is a type of ribbon that has a lightweight, flat diaphragm suspended in a frame between magnets of alternating polarity. When current passes through the conductive traces that are bonded to the diaphragm, the traces move backward or forward in the magnetic field, causing the diaphragm to move. The term "planar" refers to the magnetic field that is distributed in the same plane (parallel) to the diaphragm. Planar magnetic diaphragms are thin and lightweight as opposed to the much heavier moving-coil or dome diaphragms found in "dynamic" drivers. The diaphragm is suspended in the magnetic fields created by the magnetic arrays and a printed circuit spread across the surface of a thin-film substrate is energized with an audio signal to interact with the magnetic field and produce an electromagnetic force that moves the diaphragm back and forth to create sound waves.

FIG. 1A illustrates a planar magnetic loudspeaker 103 comprising a diaphragm frame 102 holding diaphragm 104 upon which are bonded conductive traces 108. Magnets 106 set up a magnetic field that creates the force to move the diaphragm in response to audio signal current passing through the conductive traces. A case having an upper case portion (or half) 101*a* and a lower case portion 101*b* surrounds and holds the diaphragm 102 and includes a plurality of openings or ports 110 through which the sound wave from moving diaphragm 104 is projected.

FIG. 1B illustrates the example diaphragm and the arrangement of the conductive traces for the planar magnetic loudspeaker of FIG. 1A. As shown in FIG. 1B, the conductive traces are laid out and bonded onto diaphragm 104 in an appropriate coil configuration to distribute the electric signal over the area of the diaphragm within frame 102. Signal wires 112 coupled to the conductive traces provide the audio signal from an amplifier or audio playback system to the loudspeaker 103.

FIG. 1C illustrates an example assembled planar magnetic loudspeaker driver for the diaphragm of FIG. 1B. As shown in FIG. 1C, diaphragm 104 is placed between the upper and lower case portions 101*a* and 101*b*. The upper case portion 101*a* has openings 110 arranged to allow the sound projected sound waves to pass out from the moving diaphragm. The number, size, and arrangement of the openings 110 may be of any appropriate configuration depending on the size, shape, material, and power rating of the loudspeaker, along with other relevant characteristics.

Physical surfaces such as horns or waveguides are commonly used to control the sound dispersion of planar magnetic drivers. FIG. 1D illustrates an example planar magnetic loudspeaker driver with waveguides 112, which are added to the front of the driver to control the horizontal dispersion angle of sound waves from the diaphragm or ribbon transducer 104. The surfaces shown are approximately 45 degrees either side of the direction of sound, relative to the vertical axis. As such they limit the horizontal sound dispersion angle or beamwidth to approximately 90 degrees. FIG. 1D also illustrates certain angle notations relative to the driver axes. As shown, the vertical axis 114 is assumed to be the long axis of the planar magnetic loudspeaker driver, and the horizontal axis 116 is assumed to be the short axis of the driver. The nominal direction of sound projection (in monopole operation) 118 is out the front of the driver at 0 degrees vertical and 0 degrees horizontal, as shown in FIG. 1D.

FIG. 1E illustrates an example measured dispersion pattern for the loudspeaker and waveguide arrangement in FIG. 1D. For this example, the exit height is 120 mm and the exit width, between the waveguides, is 24 mm. The horizontal beamwidth holds at approximately 90 degrees between approximately 5 kHz and 14 kHz. As can be seen in plot 120, above 14 kHz the beamwidth narrows as the sound wavelength becomes smaller than the width of the exit. FIG. 1F shows the measured vertical dispersion pattern for the loudspeaker arrangement in FIG. 1D. As can be seen in plot 130, above approximately 2.8 kHz the beam narrows as the sound wavelength becomes smaller than the height of the exit. At high frequencies, the vertical beamwidth is only a few degrees and only a listener positioned directly on axis to the loudspeaker will hear all frequencies at a similar sound level. This plot thus shows a disadvantage associated with present planar magnetic loudspeakers with regards to limited sound dispersion, namely narrow dispersion and relatively high directivity. Many applications require a loudspeaker to cover an audience area larger than just a few degrees either side of the aiming direction and as such, the planar magnetic loudspeaker driver is unsuitable.

What is needed therefore, is a planar loudspeaker system or manifold that improves dispersion of sound from the driver, and especially increases the vertical beamwidth of the loudspeaker.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments are directed to a speaker manifold designed to alter a sound wavefront shape from a loudspeaker having a substantially planar driver, comprising a mounting surface configured to attach to a front surface of a case surrounding the driver and having two vertical openings matching corresponding vertical openings in the case to allow sound from the driver to project therethrough, and a waveguide portion coupled to the mounting surface and having a structure channeling sound projected from the driver through the two vertical openings to be combined in one output area, wherein the structure has a plurality of reflective surfaces configured to create output sound that has a consistent dispersion pattern over a defined area. The structure comprises two side walls within a manifold frame forming a single large vertical opening, and a central pillar running vertically between the side walls to form the two entry columns and the one output area. The reflective surfaces are formed from contours formed into the side walls and corresponding projections formed into the central pillar to form two entry columns representing sound transmission paths for the sound projected from the driver through the two vertical openings, and wherein the output area comprises an outwardly flared sound output area. The output area comprises an outwardly angled waveguide forming a dispersion angle along a horizontal axis of the loudspeaker, and wherein the dispersion angle is approximately 90 degrees. The sidewalls may be curved inward to form a narrower sound transmission area around a center of the loudspeaker and a wider sound transmission area around opposite ends of the loudspeaker. The angled waveguide of the output area may comprise a compound flared structure having a series of flared openings each waveguide angles increased at each additional flaring element.

In an embodiment, the manifold structure is configured to increase at least one of a vertical beamwidth or horizontal beamwidth of the projected sound so that listeners positioned off an axis of the loudspeaker will hear a wide range of frequencies at a substantially similar sound level, the range of frequencies comprising approximately 200 Hz to 20 kHz. The dispersion pattern of the output sound may be symmetric or asymmetric about both the vertical axis and horizontal axis of the loudspeaker. The loudspeaker may comprise a dipole speaker having a substantially planar driver disposed on opposite sides of the loudspeaker, where a manifold frame is coupled to each driver, and the manifold frames may be of the same configuration or different configurations.

Embodiments are further directed to a method of increasing one or more dispersion angles of a loudspeaker having a substantially planar driver projecting sound through a case having two separate vertical openings, by: directing the sound projected from the two vertical openings into two entry corresponding columns of an acoustic manifold attached to a front surface of the case; channeling the sound through two transmission paths of the two entry columns to combine and form a single sound output; and projecting the single sound output through a flared output area to create output sound that has a consistent dispersion pattern over a defined area of a listening environment. In this method, the two transmission paths each have a plurality of reflective surfaces formed from a structure comprising two side walls within a manifold frame forming a single large vertical opening, and a central pillar running vertically between the side walls to form the two entry columns and the flared output area. The reflective surfaces may be formed from contours formed into the side walls and corresponding projections formed into the central pillar to form two entry columns, and wherein the flared output area comprises an outwardly angled waveguide forming a dispersion angle along a horizontal axis of the loudspeaker. The angled waveguide may comprise a compound flared structure having a series of flared openings each waveguide angles increased at each additional flaring element. In this method, the manifold structure is configured to increase at least one of a vertical beamwidth or horizontal beamwidth of the projected sound so that listeners positioned off an axis of the loudspeaker will hear a wide range of audible frequencies at a substantially similar sound level.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

FIG. 1C illustrates an example assembled planar magnetic loudspeaker driver for the diaphragm of FIG. 1B.

FIG. 1D illustrates an example planar magnetic loudspeaker driver with waveguides and angle annotations.

DETAILED DESCRIPTION

Embodiments are described for a novel loudspeaker manifold or horn structure that alters the dispersion pattern of a planar magnetic loudspeaker driver. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the term "loudspeaker" means a complete loudspeaker cabinet incorporating one or more loudspeaker drivers; a "driver" or "loudspeaker driver" means a transducer which converts electrical energy into sound or acoustic energy. Sound dispersion describes the directional way sound from a source (e.g., a loudspeaker) is dispersed or projected. Wide dispersion, or low directivity, indicates that a source radiates sound widely and fairly consistently in many directions; the widest being omnidirectional where sound radiates in all directions. Narrow dispersion, or high directivity, indicates that a source radiates sound more in one direction and predominantly over a limited angle. Dispersion and directivity can be different in different axes (e.g., vertical and horizontal) and can be different at different frequencies. Dispersion can also be asymmetric; that is, the dispersion in one axis can also vary for different angles or directions on another axis. The term "beamwidth" means the angle between the points where the sound pressure level is 6 dB lower than the level in the main direction of aim.

Embodiments are directed to an acoustic manifold for use with a planar loudspeaker that widens the dispersion, and especially the vertical beamwidth of a planar magnetic loudspeaker driver. The device is compact enough that the planar magnetic driver can still be used as the high-frequency driver in front of a larger, low-frequency driver in a coaxial arrangement and without significantly altering the dispersion pattern of the low-frequency driver in the coaxial arrangement.

Figure 2:
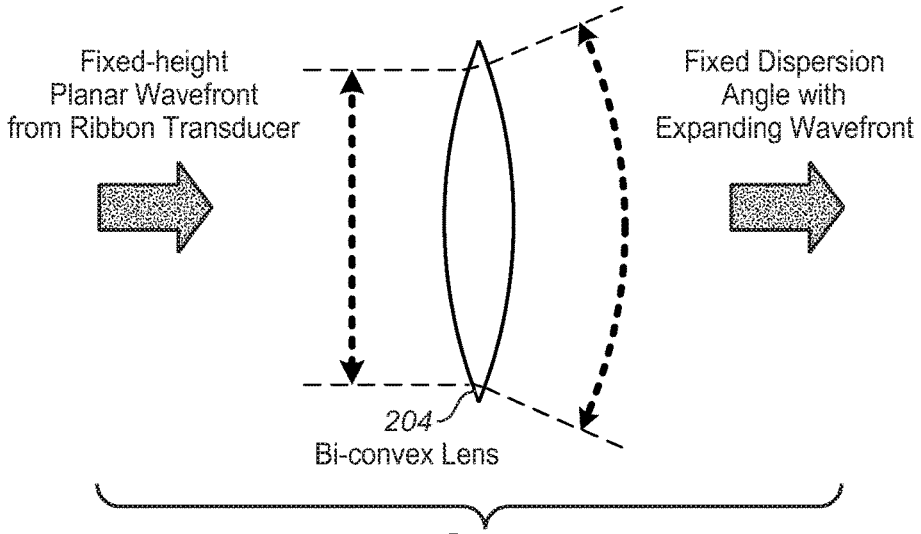
FIG. 2 illustrates an optical analogy of desired acoustic behavior, as used by a loudspeaker manifold under some embodiments.

FIG. 2 shows, by way of an optical lens example, an effect of beamwidth widening achieved by a loudspeaker manifold under some embodiments. In optics, a light beam of fixed width, when passed through an optical bi-convex lens 204, becomes a light beam with an approximately fixed angle of dispersion. In the acoustic realm and according to embodiments of a loudspeaker manifold, a fixed-width acoustic wavefront passes through the acoustic equivalent of a bi-convex lens, resulting in an example wavefront with an angle defined by the acoustic lens. In an embodiment, the acoustic lens effect is created by specific reflection paths, as shown and described in greater detail below.

Figure 3:
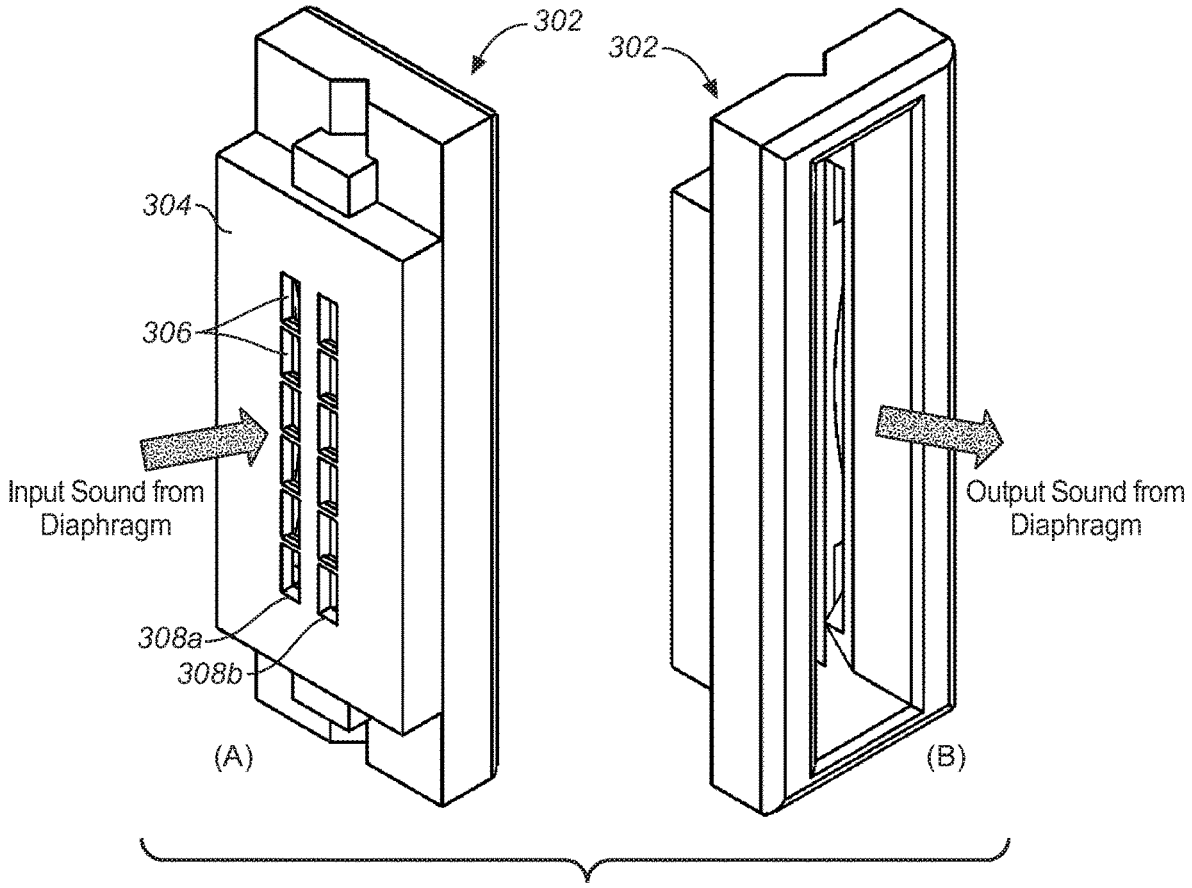
FIG. 3 illustrates a manifold structure for a planar magnetic driver for improved sound dispersion under some embodiments.

FIG. 3 illustrates a manifold structure for a planar magnetic driver for improved sound dispersion under some embodiments. FIG. 3(*a*) illustrates a back side of manifold 302 and FIG. 3(*b*) illustrates a front side of manifold 302. The back side has a surface 304 that is mounted to or placed proximately in front of the diaphragm frame 102 of a planar magnetic loudspeaker. Input sound from the planar magnetic driver (not shown) enters the manifold in the direction shown and through holes 306, and exits through the front side as shown in FIG. 3(*b*). In an embodiment, the size, shape, and arrangement of holes 306 in the manifold 302 are configured to match the hole configuration of the driver. For the embodiment of FIG. 3, the holes 306 are arranged in two columns of 6 holes each denoted entry column A (308*a*) and entry column B (308*b*) to correspond to the hole arrangement of a given planar magnetic driver, such as driver 109 in FIG. 1C.

Figure 4:
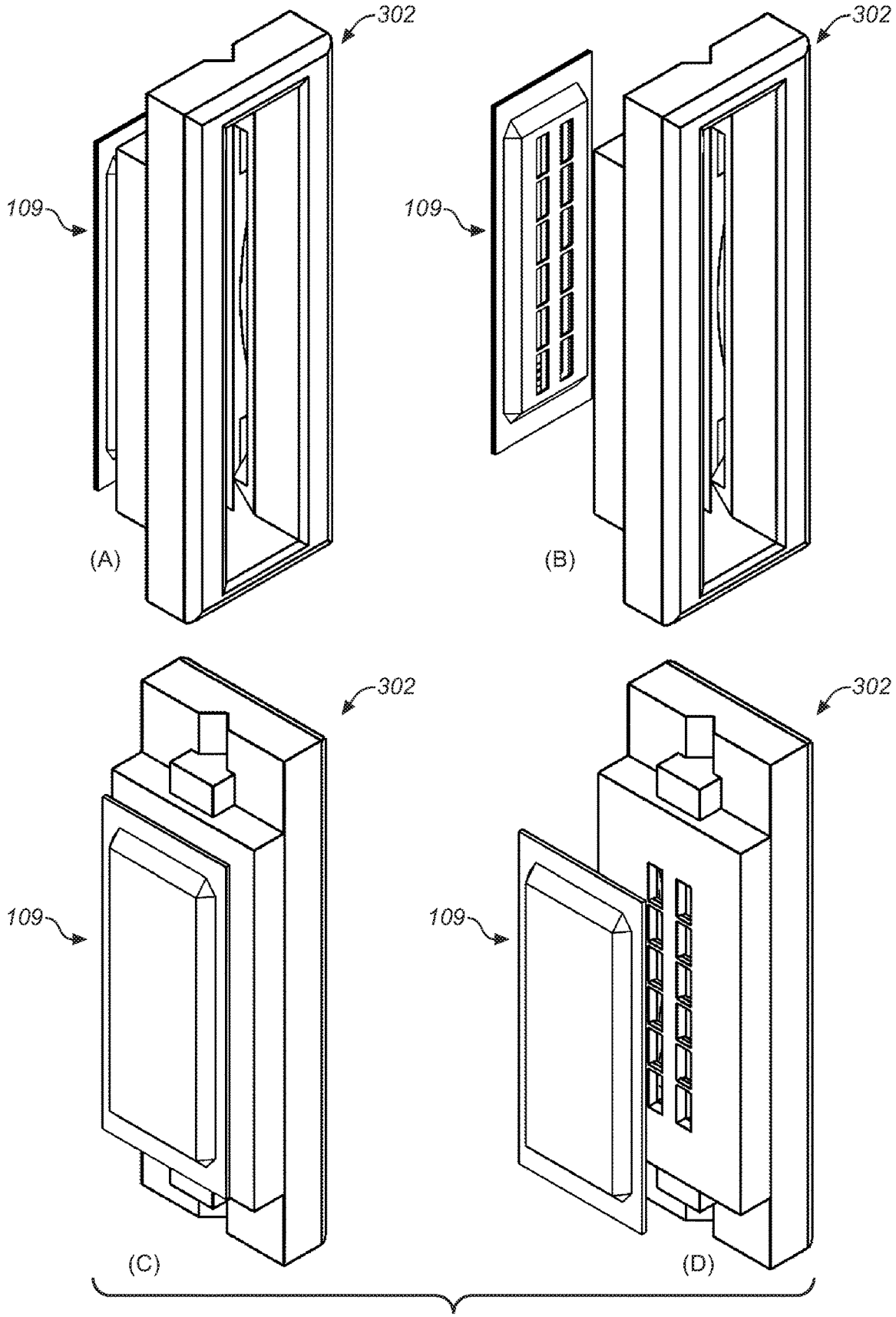
FIG. 4 shows the manifold of FIG. 3 with an example planar magnetic driver mounted onto the manifold.

FIG. 4 shows the manifold of FIG. 3 with an example planar magnetic driver mounted onto the manifold. FIG. 4(*a*) shows how a transducer driver, such as driver 109 of FIG. 1C, is mounted to the back surface 304 of the manifold 302, and FIG. 4(*b*) shows the transducer driver 109 spaced slightly apart from the manifold 302 to show how the holes (e.g., holes 110 in FIG. 1C) on the driver match the holes 306 on the entry to the manifold. FIGS. 4(*c*) and 4(*d*) show the back side of the arrangements shown in FIGS. 4(*a*) and 4(*b*), respectively. Driver 109 is intended to represent any type of known planar magnetic driver that may be used with manifold 302, though embodiments are not so limited.

As shown in FIG. 3(*a*), the manifold 302 has two entry columns 308*a* and 308*b*, which match the exits of the planar magnetic loudspeaker (e.g., 109) in all dimensions. In the example arrangement shown, the holes are arranged in two columns with horizontal spacers dividing the entry columns vertically into smaller holes. In general, the size of these horizontal spacers or cross-braces is not overly important; and in an embodiment, they are internally sloped to a point to reduce the effects of diffraction at the corresponding spaces on the planar magnetic driver. In the driver, the two columns may be true uninterrupted columns, but spacers are often used exist to strengthen the case and hold the central magnets in place.

Figure 5:
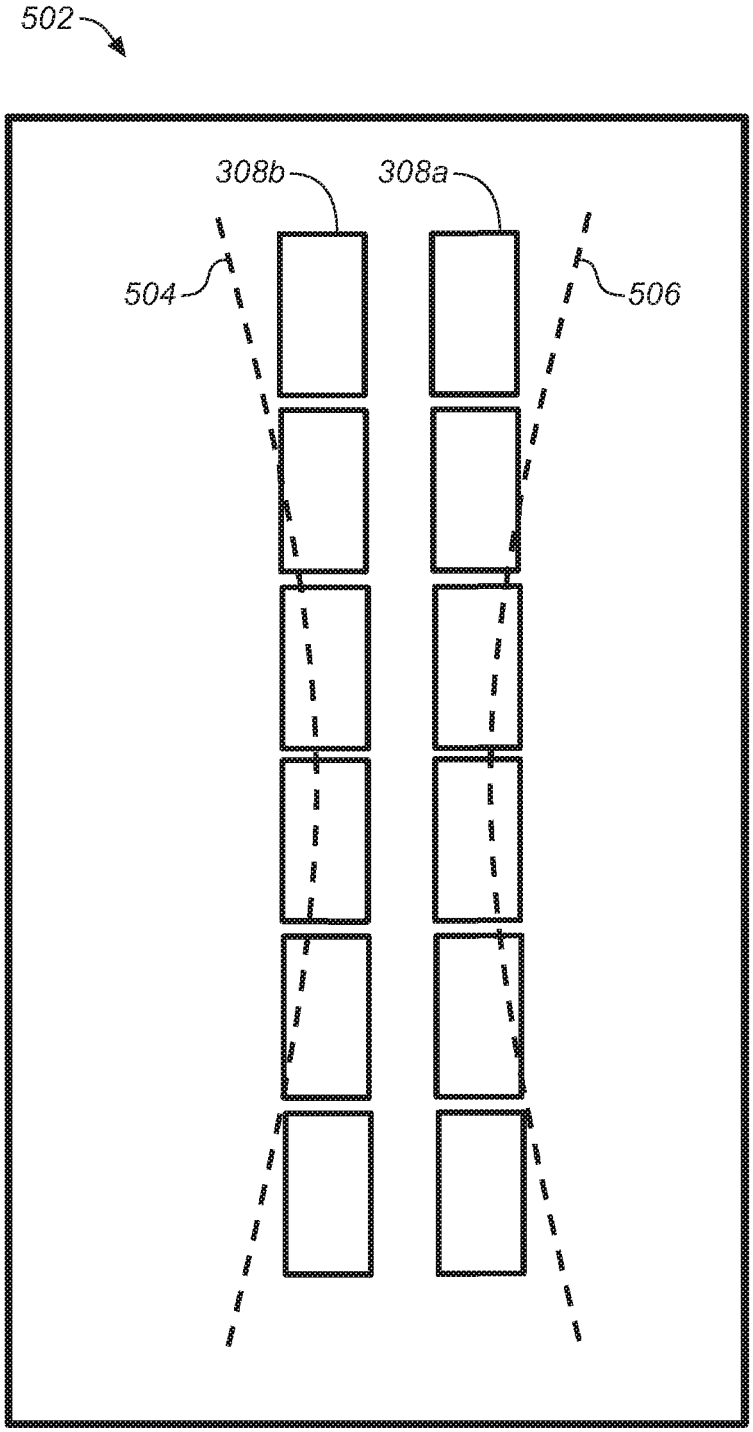
FIG. 5 illustrates an arrangement of curved surfaces relative to the manifold openings under some embodiments.

In an embodiment, the manifold 302 incorporates curved surfaces to impart an acoustic lens effect, similar to that shown in the optic analog of FIG. 2. FIG. 5 illustrates an arrangement of curved surfaces relative to the manifold openings under some embodiments. As shown in FIG. 5, manifold 502 includes a plurality of sound transmission holes arranged in two columns 308*a* and 308*b*. Curved surfaces 504 and 506 are attached to or formed into interior walls of the manifold. The length, curvature, and spacing of the curved surfaces 504 and 506 are selected to impart the desired dispersion effect to the sound as it is output from the driver through manifold 502.

Figure 6:
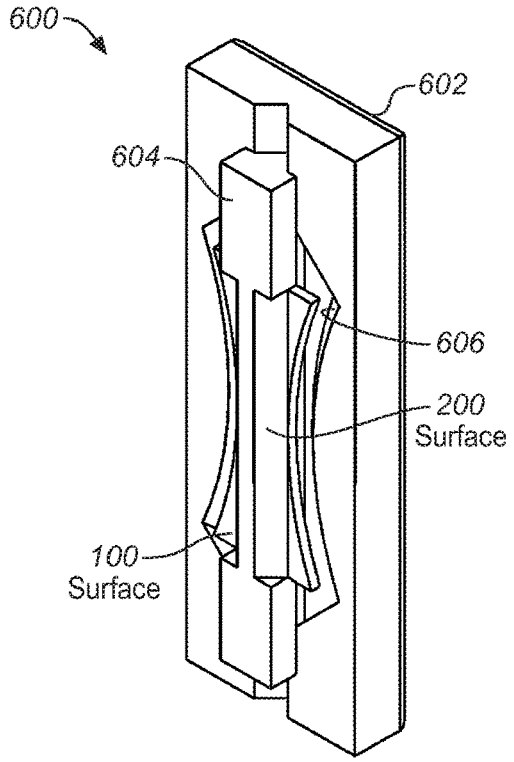
FIG. 6 illustrates a cross-section view of a manifold having certain surfaces and curved elements under some embodiments.
Figure 7:
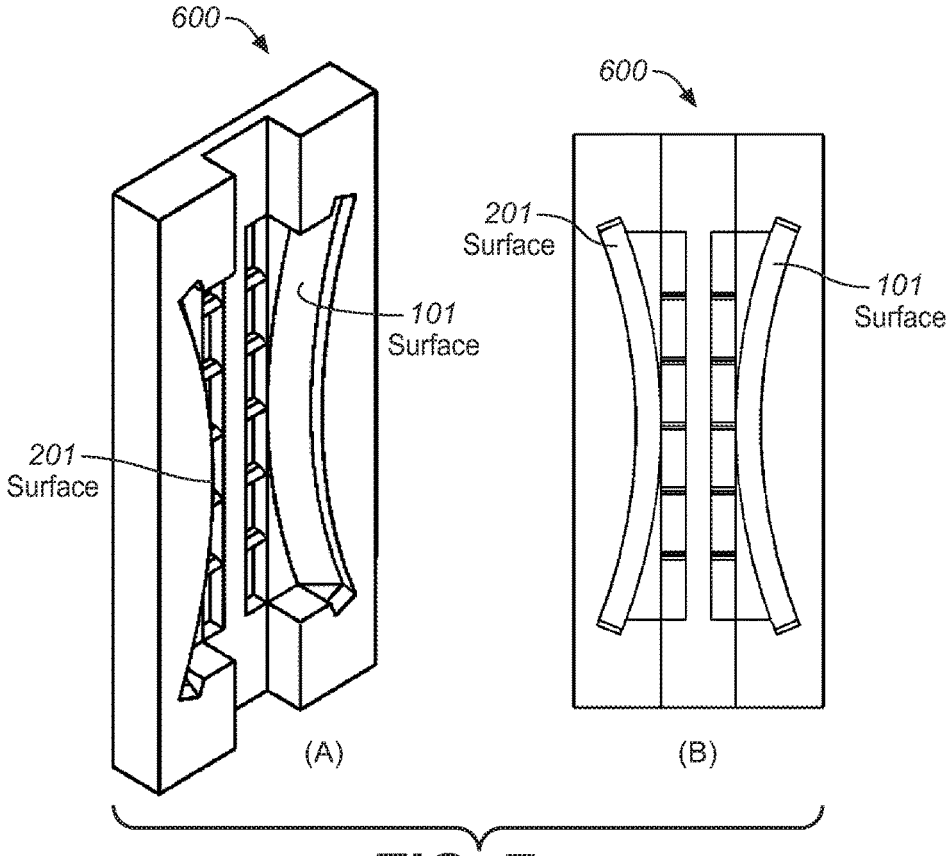
FIG. 7 shows the manifold of FIG. 6 with surfaces provided by the certain curved elements.

FIG. 6 illustrates a cross-section view of a manifold having certain surfaces and curved elements under some embodiments. As shown in FIG. 6, manifold 600 has a main frame structure 602 into which may be cut a curved open area 606. A central element 604 runs down the length of the manifold frame and provides angled surfaces 100 and 200 for reflection of sound as it passes from the diaphragm and through the manifold. FIG. 7 shows the manifold of FIG. 6 with surfaces provided by certain curved elements. As shown in FIGS. 7(*a*) and 7(*b*), curved surfaces denoted surfaces 101 and 201 are formed by respective curved elements or members attached to or formed into the frame of manifold 600. The surface labels shown in FIGS. 6 and 7 will be used below to show corresponding reflection points as sound passes through the manifold 600.

Figure 8:
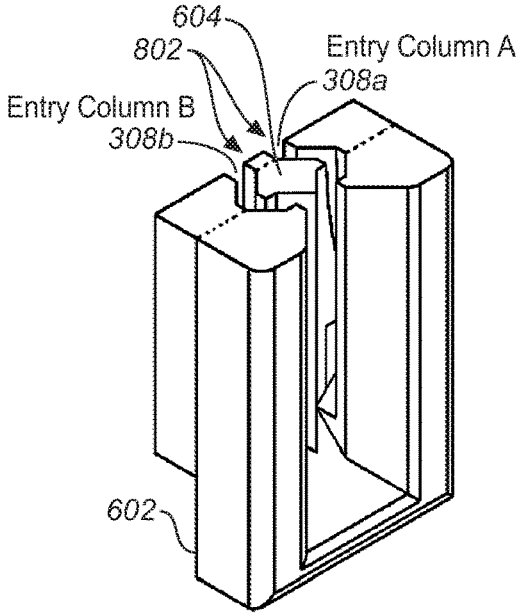
FIG. 8 illustrates a cross-section of the manifold of FIG. 6 under some embodiments.
Figure 9:
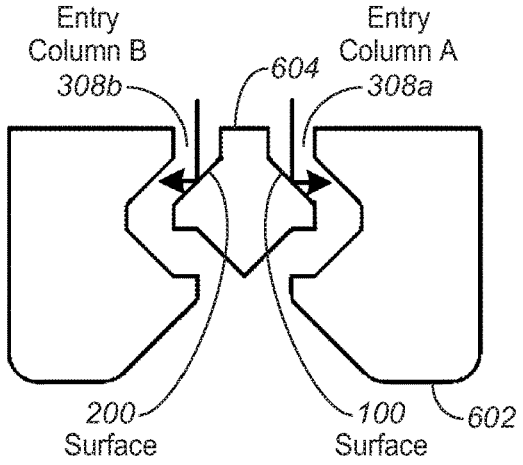
FIG. 9 shows the initial path of the input sound as it enters the manifold of FIG. 8.

FIG. 8 illustrates a cross-section of the manifold of FIG. 6 under some embodiments. As shown in FIG. 8, the manifold comprises the frame 602 and center element 604 that defines the two entry columns 308*a* and 308*b*. The input sound 802 passes through the two entry columns around the center element 604. FIG. 9 illustrates the initial path of the input sound as it enters the manifold of FIG. 8. The sound wavefront entering column A 308*a* reflects perpendicularly off straight surface 100. Similarly the sound wavefront entering column B 308*b* reflects perpendicularly off straight surface 200.

Figure 10:
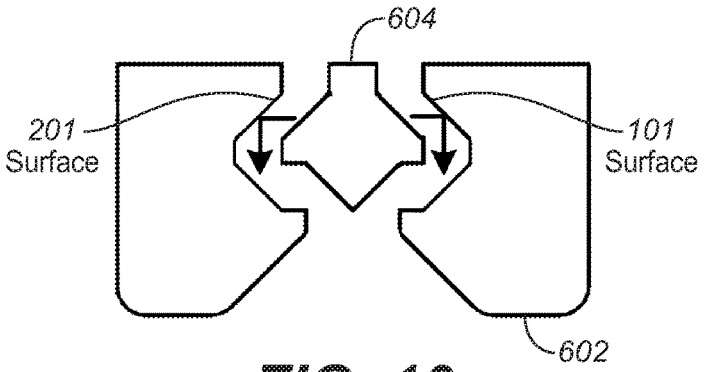
FIG. 10 shows a following path of the input sound after reflecting off surfaces shown in FIG. 9.

After reflecting off surface 100, the wavefront then reflects off curved surface 101; similarly, wavefront reflected off surface 200 then reflects off curved surface 201, as shown in FIG. 10. In an embodiment, surfaces 101 and 201 have the same arc angle. After reflecting of the first curved surfaces 101 and 201, both wavefronts are expanding vertically.

Figure 11:
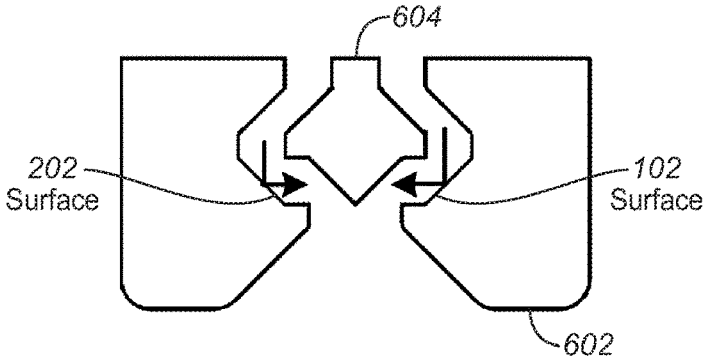
FIG. 11 shows the path of the sound wavefront after the reflection of FIG. 10.
Figure 12:
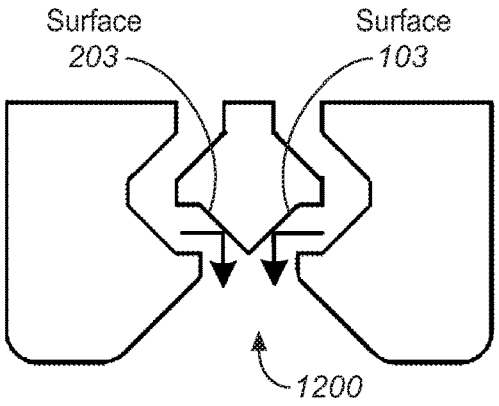
FIG. 12 shows the path of the sound wavefront after the reflection of FIG. 11.
Figure 13:
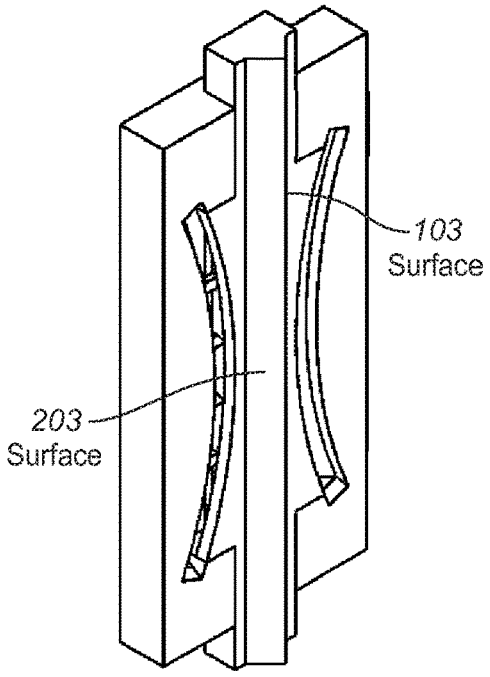
FIG. 13 illustrates the corresponding surfaces of FIG. 12 for the manifold of FIG. 6.
Figure 14:
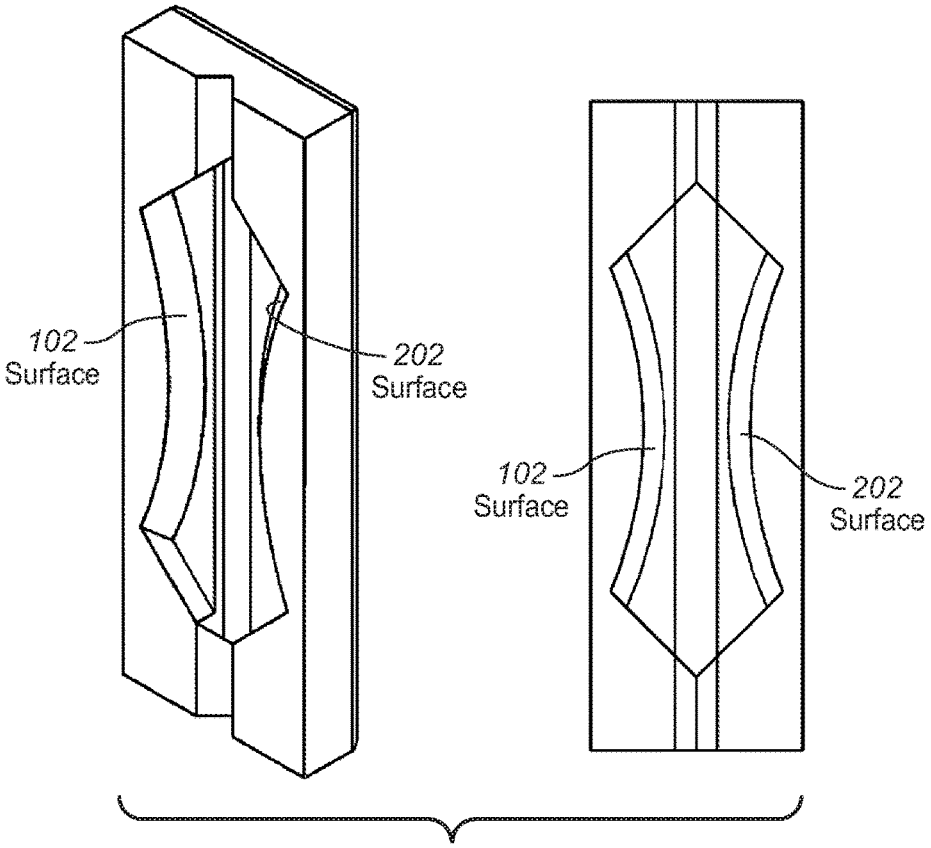
FIG. 14 illustrates a manifold with the second curved reflective surfaces under some embodiments.

FIG. 11 shows the path of the sound wavefront after the reflection of FIG. 10. After reflecting off curved surfaces 101 and 201, the sound wavefront progresses toward the front of the manifold through two interior, curved slots, shown in cross section in FIG. 7*a*. From this point, the wavefronts are brought back together to a common exit, as shown in FIG. 12. FIG. 12 shows that the wavefront reflection from surface 101 then reflects off a second curved surface 102 and then reflects off the flat vertical surface 103. Similarly, the wavefront from surface 201 reflects off a second curved surface 202, then reflects off the flat vertical surface 203. FIG. 13 illustrates the corresponding surfaces of FIG. 12 for the manifold of FIG. 6. Sound from both paths 308*a* and 308*b* then exit together through the single opening 1202 of the manifold, as shown in FIG. 12. FIG. 14 illustrates a manifold with the second curved reflective surfaces 102 and 202 under some embodiments.

Figure 15:
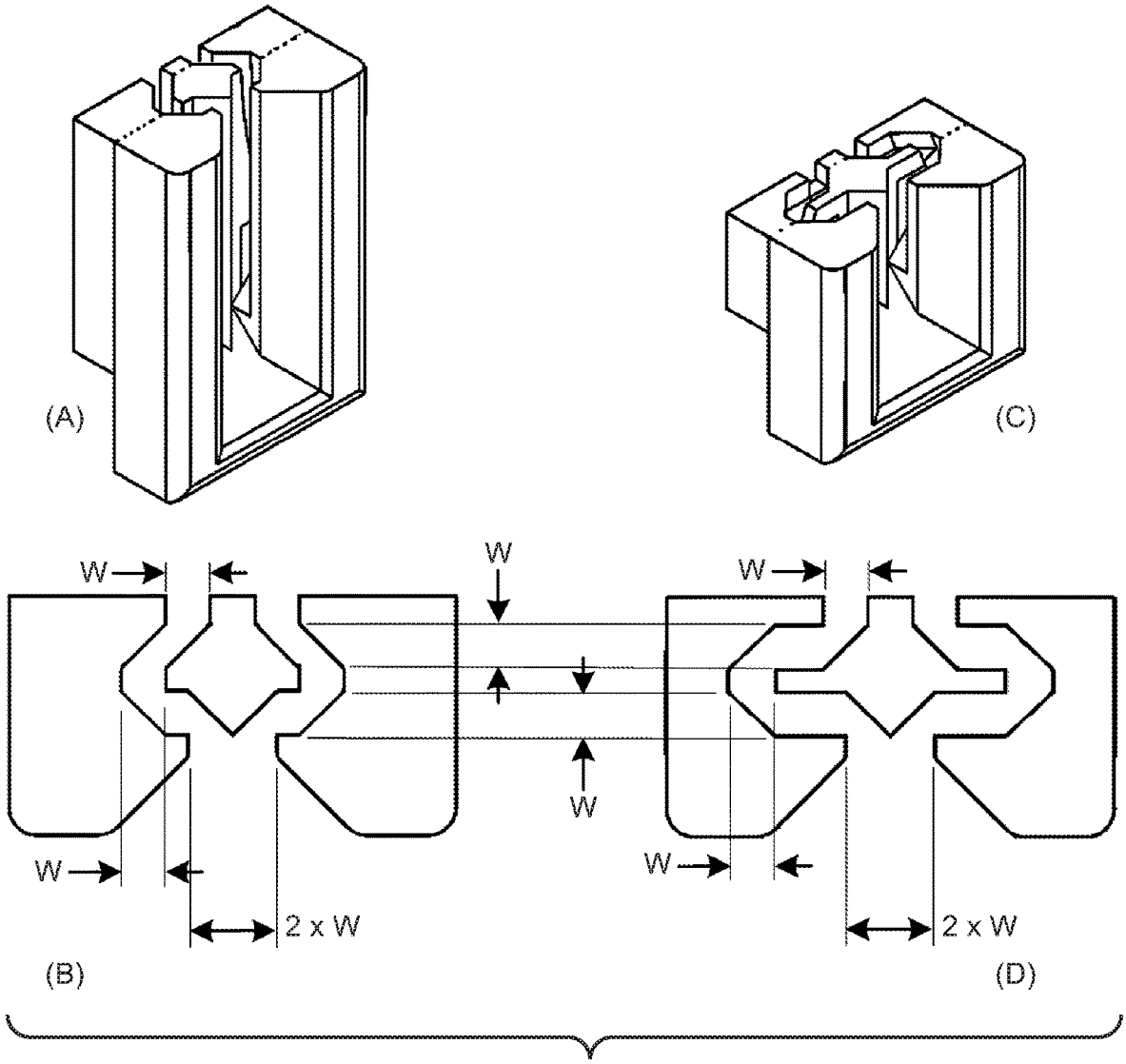
FIG. 15 shows two different cross-sectional views of a manifold under some embodiments.

In order to maintain well-controlled wavefront expansion and minimize unwanted internal reflections, resonances and diffraction, it is important to maintain some consistent dimensions inside the manifold. FIG. 15 shows two different cross-sectional of the manifold, with FIG. 15(*a*) showing a cross-section at the center, and FIG. 15(*c*) showing a cross-section towards one end. The width of each entry column is denoted as W which can be represented in millimeters, inches or some other unit of distance. In between reflection surfaces, it is preferred that the tunnel widths be the same, again all denoted with a W. The exit, however is twice the tunnel width (i.e., exit=2×W) as shown, in FIG. 15 since sound from both paths exits side by side. FIGS. 15(*b*) and (*d*) show the example manifold horizontal tunnel dimensions as just described for each respective cross-section shown in FIGS. 15(*a*) and 15(*c*). The term "tunnel" as used herein means the void area defined by the manifold frame 602 and center element 604 and represents the path of the sound waves through entry columns A and B (308*a*, 308*b*), as they enter the manifold and exit through port or opening 1200.

Figure 16:
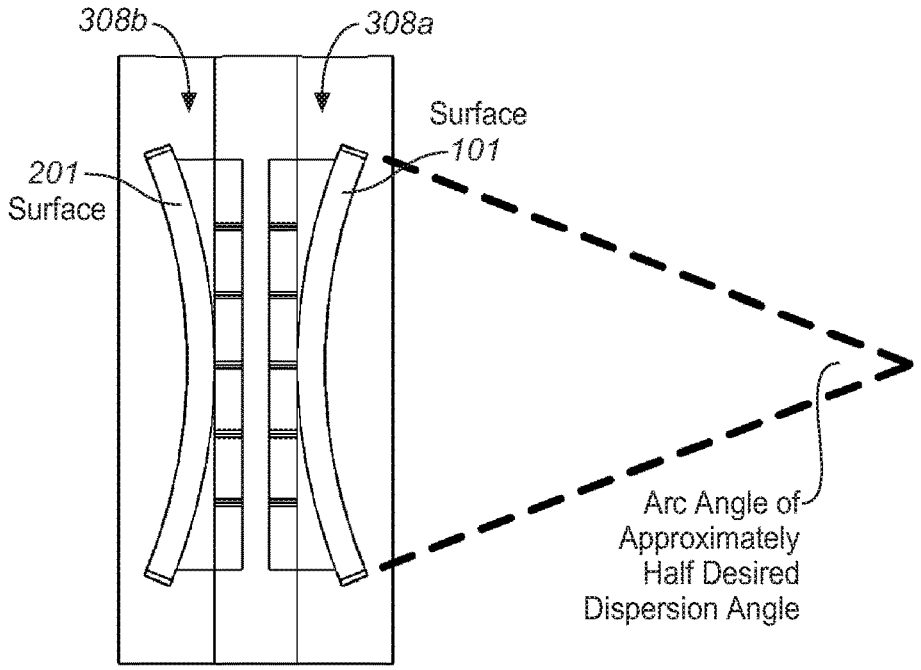
FIG. 16 shows curved reflection surfaces and arc angle for a first column of the manifold of FIG. 6 under some embodiments.
Figure 17:
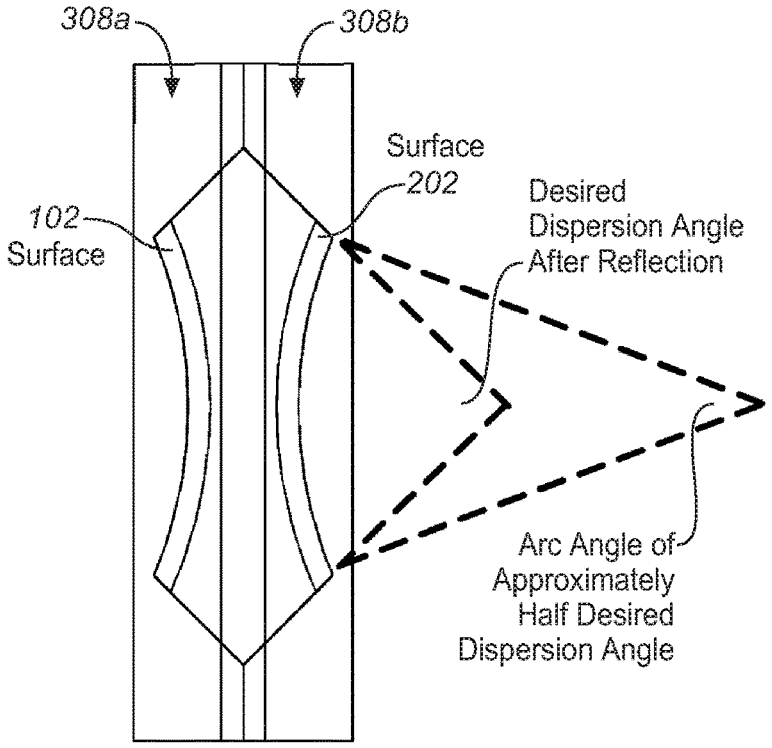
FIG. 17 shows curved reflection surfaces, arc angle and dispersion angle for the second column of the manifold of FIG. 6 under some embodiments.
Figure 18:
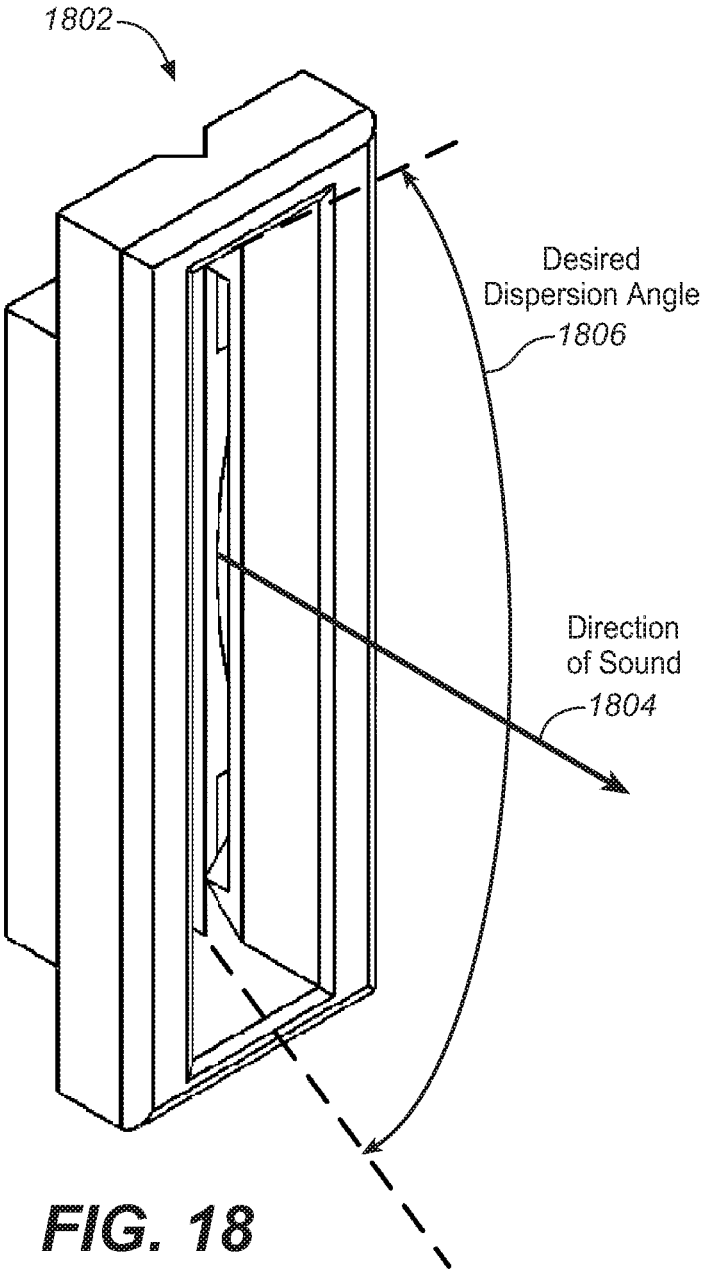
FIG. 18 illustrates a desired vertical dispersion angle for a manifold under some embodiments.

FIGS. 16 and 17 illustrate optimum arc angles for the surfaces of the manifold of FIG. 6 under some embodiments. FIG. 16 shows a first side of the manifold with columns A (308*a*) and B (308*b*), and FIG. 17 shows the opposite side so that the columns 308*a* and 308*b* are reversed. Since the wavefront entering at column A reflects of two curved surfaces 101 (in FIG. 16) and 102 (in FIG. 17) as it passes through the manifold, each curved surface needs to only have an arc angle of approximately half the final desired dispersion angle, as shown in FIG. 17. For example, for a 60 degree vertical beamwidth, each arc needs to only be approximately 30 degrees. After reflecting off both surfaces, the wavefront will be expanding vertically with an arc of approximately 60 degrees. Similarly, for Column B, surfaces 201 (in FIG. 16) and 202 (in FIG. 17) need to only have an arc angle of approximately half the desired dispersion angle. FIG. 18 illustrates a desired vertical dispersion angle for a manifold under some embodiments. As shown in FIG. 18, sound radiates outward in direction 1804 from manifold 1802. The desired dispersion angle 1806 shows the sound radiating outward along the vertical plan of manifold 1802.

The dimensions of the may be tailored depending on system requirements, and many different configurations and sizes are possible. In general, the dimensions may be derived from formulae relating to dispersion angles for conical horn drivers. Sound from a loudspeaker driver enters the horn at the throat and exits at the mouth, and an empirical formula, such as that derived in the 1970's by D. B. Keele, Jr. shows that for calculating the acoustically optimal mouth width M in meters for a horn, as a function of the dispersion angle Ø in degrees and lowest desired operating frequency $F_L$ in Hz, the following equation should be used:

$$M = \frac{25000}{\phi \cdot F_L}$$

For example, for a dispersion angle of 60 degrees and lowest operating frequency of 1 kHz, the optimal mouth width is approximately 417 millimeters.

Figure 19:
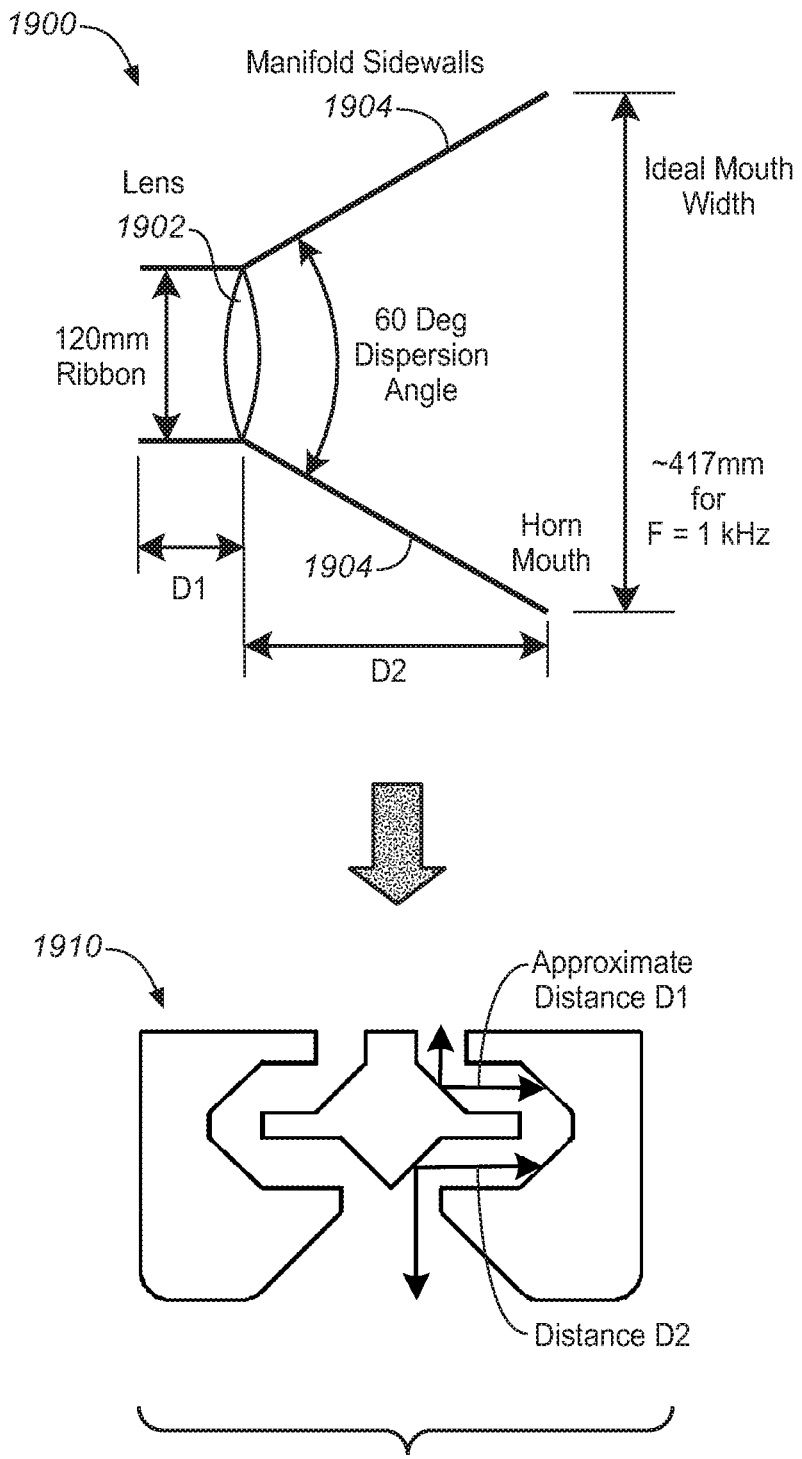
FIG. 19 shows a representation of the vertical characteristics of a driver with a certain dispersion angle and corresponding reflection distances for a manifold under some embodiments.

FIG. 19 shows a representation of the vertical characteristics of a driver with a certain dispersion angle and corresponding reflection distances for a manifold for the example values given above. Diagram 1900 shows a 120 mm planar magnetic driver mounted to a manifold with a vertical dispersion angle of 60 degrees. Similar to FIG. 2, the "lens" 1902 is intended to conceptually represent the curved reflective surfaces and is not an actual element of the speaker or manifold system. It shows how the curved surfaces at the effective "mouth" of the horn, vertically disperse the sound at a 60 degree angle, and how the optimal mouth width is about 417 mm for F=1 kHz, as calculated using the above formula for certain example values. As shown in FIG. 19, a distance D1 is the distance from the driver ribbon to the mouth, and D2 is the length created by the manifold sidewalls 1904. Diagram 1910 of FIG. 10 shows how the distances D1 and D2 in diagram 1900 relate to the actual manifold, in cross section.

Figure 20:
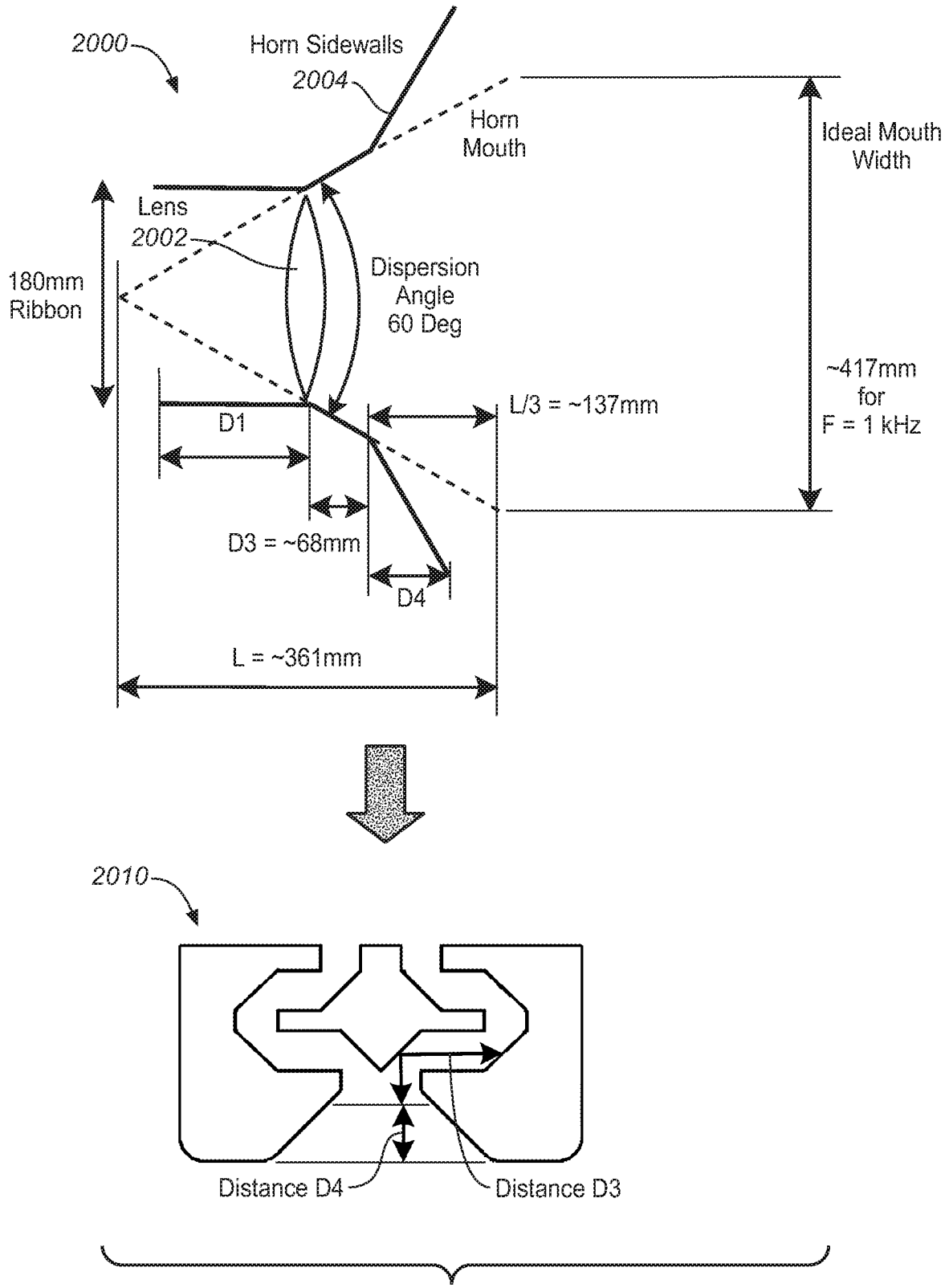
FIG. 20 shows a representation of the vertical characteristics of a flared driver with a certain dispersion angle and corresponding reflection distances for a manifold under an example embodiment.

In an embodiment, certain horn flaring techniques can be used to reduce dispersion narrowing. Certain empirical methods for reducing an effect in horns designed according to the above equation, were developed (e.g., by D. B. Keele Jr.) so that the horns dispersion narrows to an angle significantly smaller than the angle between the horn sidewalls. FIG. 20 illustrates a diagram of a horn utilizing this horn flaring technique. This empirical method generally involves flaring the last portion of the horn outward, such as flaring the last approximately ⅓ of the horn is flared to twice the desired dispersion angle.

FIG. 20 shows a representation of the vertical characteristics of a flared driver with a certain dispersion angle and corresponding reflection distances for a manifold under an example embodiment. Diagram 2000 shows a 180 mm planar magnetic driver mounted to a manifold with a vertical dispersion angle of 60 degrees. As with FIG. 19, the "lens" 2002 is intended to conceptually represent the curved reflective surfaces and is not an actual element of the speaker or manifold system. FIG. 20 illustrates a diagram of a horn utilizing a horn flaring technique that reduces an effect of horn dispersion narrowing. This flared effect can be incorporated into the horn sidewalls 2004 by dividing the distance D2, shown in FIG. 19, into two distances D3 and D4, shown in FIG. 20. The distance D3 represents the horizontal distance from the curved reflection to where the additional flaring starts and D4 represents the horizontal distance from the flaring start to the outside of the manifold. Diagram 2010 shows example dimensions for a 180 mm length planar magnetic driver and a dispersion angle of 60 degrees. The flared section could extend out the full last ⅓ of the ideal horn length L, or stop a little shorter, as shown.

Figure 21A:
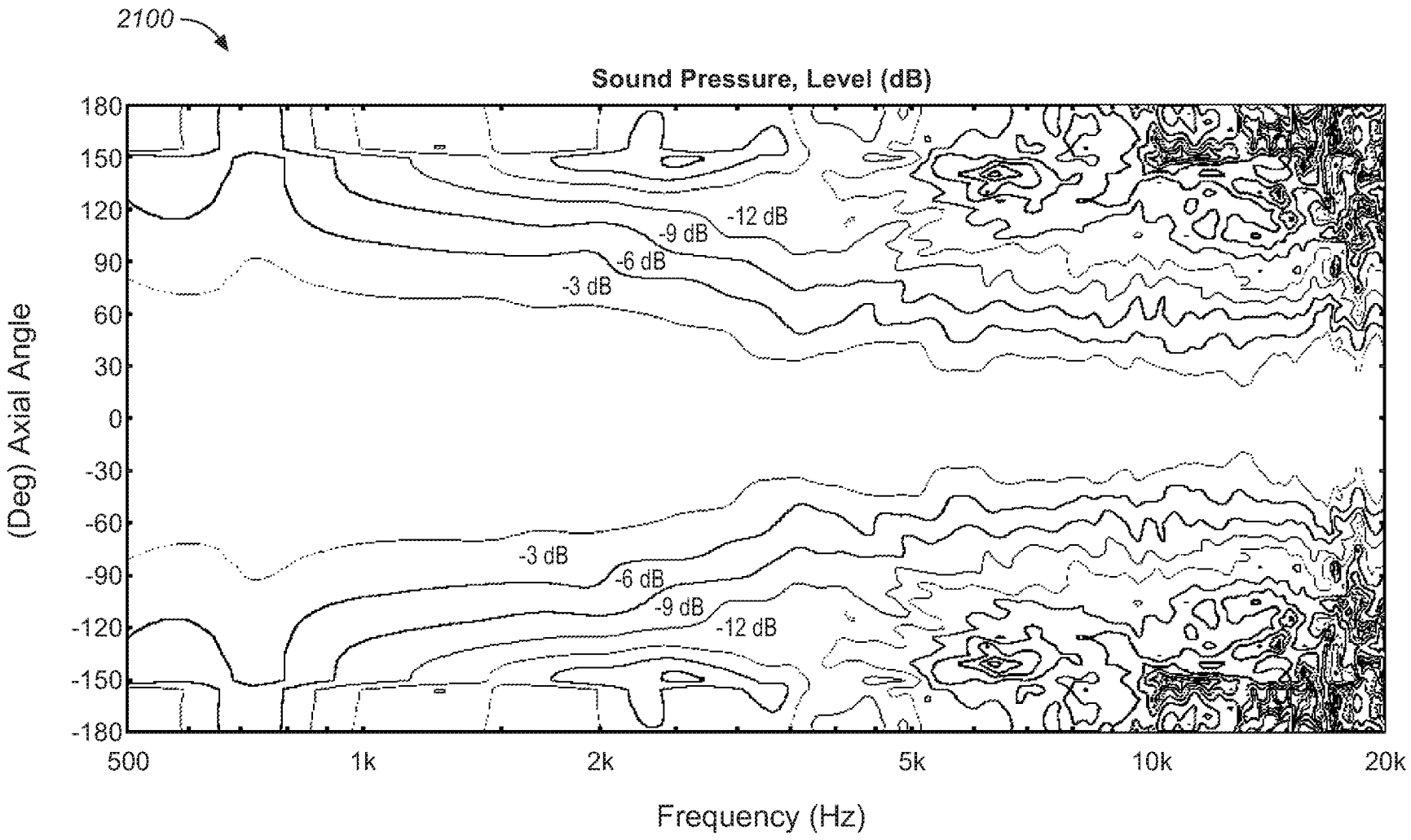
FIG. 21A shows a measured horizontal dispersion pattern for the same driver as that of FIG. 1E, but with a 90 degree horizontal/90 degree vertical manifold.
Figure 21B:
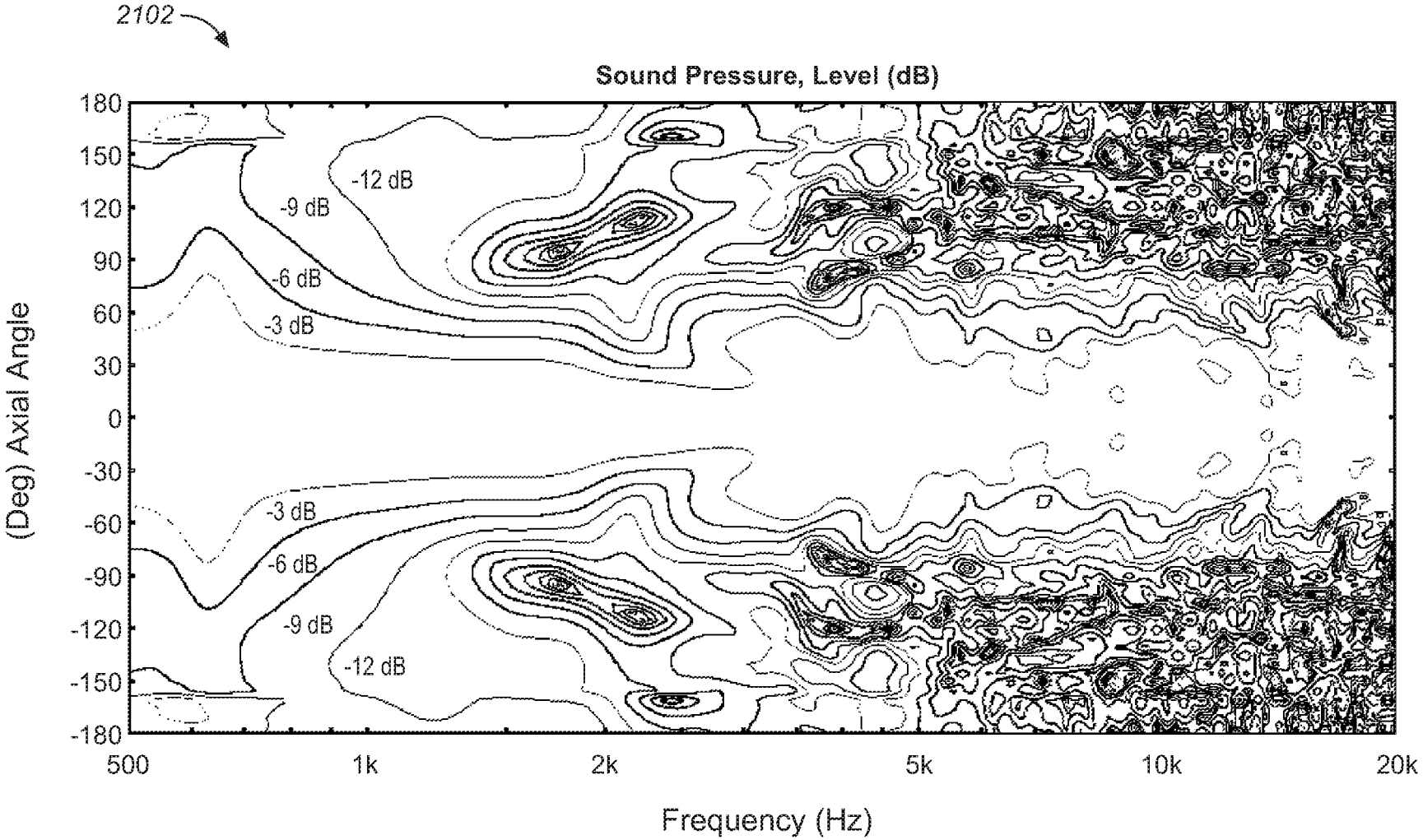
FIG. 21B shows a measured vertical dispersion pattern for the same driver as that of FIG. 1E, but with a 90 degree horizontal/90 degree vertical manifold.

The embodiments above show certain vertical dispersion benefits. Certain horizontal dispersion benefits may also be realized. As shown and described in the embodiments above, the manifold brings the two separate columns (A and B) of sound from the planar magnetic driver together to a single vertical exit. The manifold's horizontal opening width is the same as the open width of the driver, without the spacing separating the columns. For example for a planar magnetic driver with two 8 mm wide openings and with an 8 mm space in between, the manifold has a 16 mm wide exit. This reduction in horizontal width gives more consistent horizontal beamwidth at high frequencies, as shown for example with the beamwidth narrowing in FIG. 1E above 14 kHz. FIGS. 21A and 21B shows the measured horizontal and vertical dispersion patterns for the same driver as that of FIG. 1E, but with a 90 degree horizontal/90 degree vertical manifold. As shown in FIG. 21A, for horizontal dispersion, above 14 kHz, there is not any significant narrowing and the beamwidth is approximately the intended 90 degrees (compare to FIG. 1E). FIG. 21B shows the measured vertical dispersion pattern of the same driver of FIG. 1F with a 90 degree horizontal/90 degree vertical manifold. As shown in FIG. 21B, with the exception of a small region around 3 kHz, the −6 dB vertical beamwidth is at least 90 degrees and clearly much wider than the driver without manifold shown in the plot of FIG. 1F. With respect to actual driver configurations used to generate plots 2100 and 2102, FIG. 21A shows an example horizontal dispersion pattern for a 120 mm planar magnetic loudspeaker with 90 degree horizontal and 90 degree vertical manifold with additional flaring; and FIG. 21B shows an example vertical dispersion pattern for a 120 mm planar magnetic driver with a 90 degree horizontal and 90 degree vertical manifold with additional flaring. Other manifold and driver configurations may yield different dispersion patterns, but a relative comparison with the default plots of FIGS. 1E and 1F should yield similar results. The manifold is generally designed to make a constant beamwidth around +45 degrees for the 90 degree desired dispersion angle. Other configurations and desired dispersion angles are also possible.

Embodiments have been described with respect to producing symmetric dispersion for either or both of the vertical and horizontal dispersion patterns. Embodiments may also be directed to producing asymmetric dispersion. Since the shape of the reflection curves predominantly determine the vertical coverage angle and dispersion pattern, shapes other than circular arcs could be used. For example an arc with less curvature at the top and more curvature at the bottom could be used to project more sound energy further from the top the planar magnetic driver to the rear of an audience area, whilst spreading sound energy from the lower part of the planar magnetic driver to the audience sitting proximately below the aiming direction of the driver.

This variation in vertical dispersion could be combined with variations in the horizontal dispersion of the manifold using variations in the horizontal angle between the sidewalls at the exit, and/or using variations in the manifold exit slot width. For example the upper part of the manifold could have a narrower horizontal beamwidth to help project sound energy further to the rear of an audience area, and the lower part of the manifold could have a wider horizontal beamwidth to better spread sound to the nearer audience.

Embodiments are directed to planar magnetic drivers, but other loudspeaker drivers can also be used in conjunction with the manifold described and illustrated above. Such drivers can be other approximately planar output loudspeaker drivers such as air motion transformers or air velocity transformers and electrostatic loudspeakers. Since these drivers usually have one exit or output area (and not two as for a planar magnetic driver) they generally do not require two paths and two pairs of curved reflection surfaces. In one case, they could use a pair of curved surfaces, similar to one of the right or left half of the manifold described above. Alternatively they could be oriented at approximately 90 degrees to the intended direction of sound and reflect off just one curved surface, which both reflects the sound forward and adds vertical expansion. Furthermore the single curved reflection surface could be shaped to provide wavefront expansion in both axes and even asymmetrical expansion.

Another alternative speaker is a dipole loudspeaker. A dipole loudspeaker radiates sound approximately equally both forward and backward, where the rear sound is 180 degrees out of phase relative to the forward sound. A simple dipole loudspeaker consists of a loudspeaker driver mounted in a panel, with both the front and rear of the driver open to radiate sound. Little to no sound energy is radiated to the sides, due to the effective cancellation of sound at from both the front and rear of the driver. For low and mid frequencies, dipole speakers are sometimes preferred over monopole loudspeakers since they are less influenced by room modal behavior and cause less reflections off of the side walls. At high frequencies, sound from the rear can reflect off surfaces and walls behind the loudspeaker, creating a more diffuse sound.

Figure 1A:
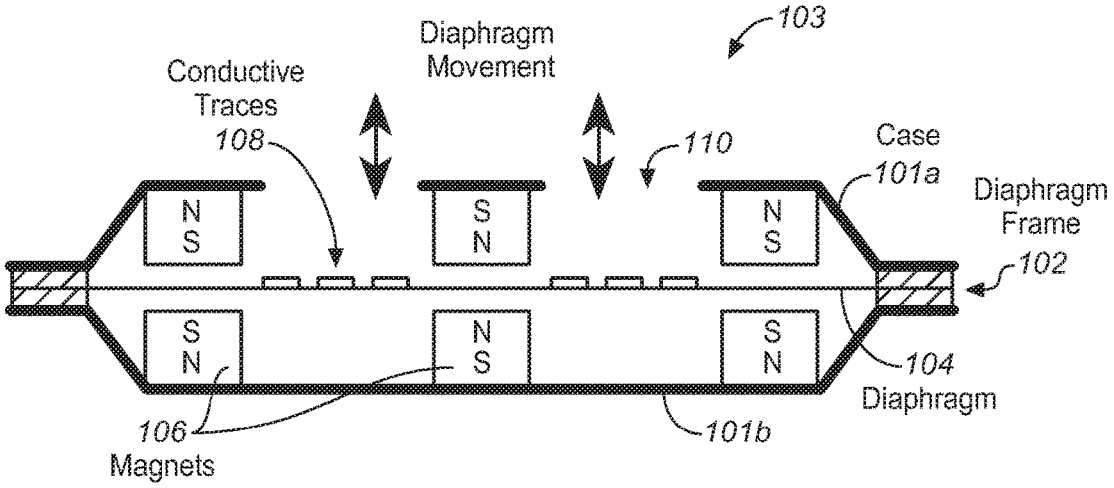
FIG. 1A (PRIOR ART)
FIG. 1A illustrates a cross-section view of a planar magnetic loudspeaker driver as is presently known.
Figure 1B:
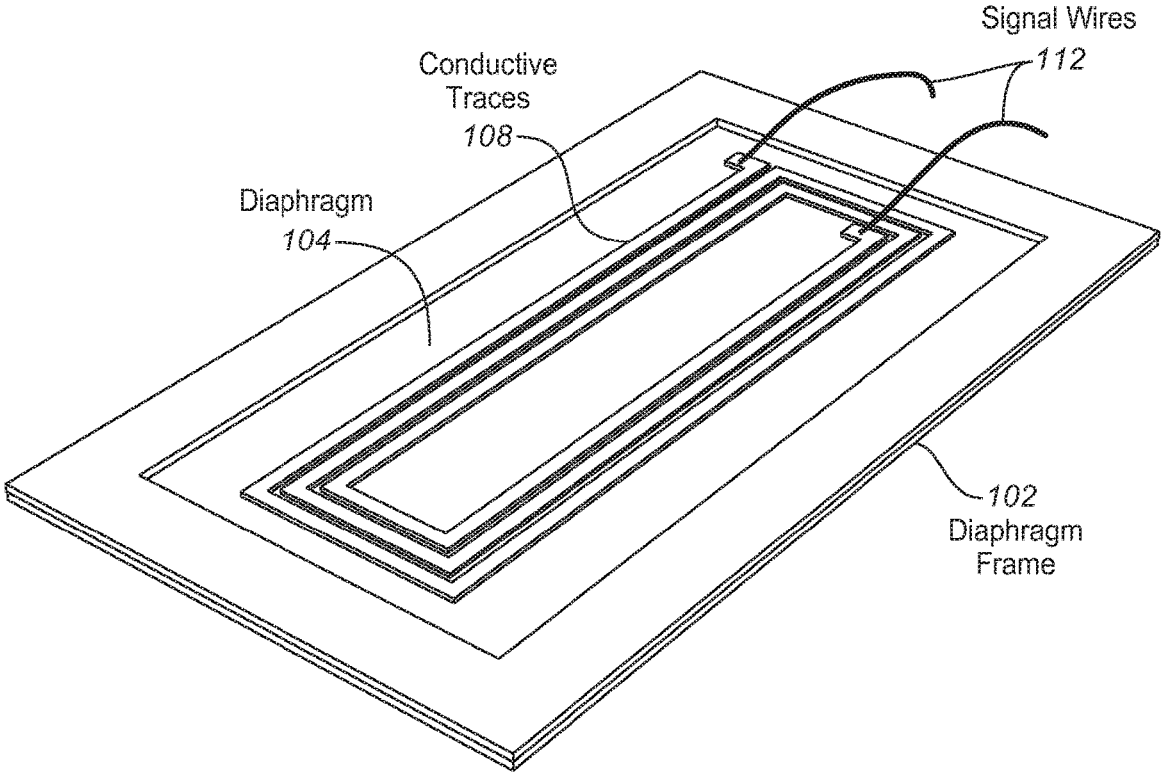
FIG. 1B (PRIOR ART)
FIG. 1B illustrates the example diaphragm and the arrangement of the conductive traces for the planar magnetic loudspeaker of FIG. 1A.
Figure 1E:
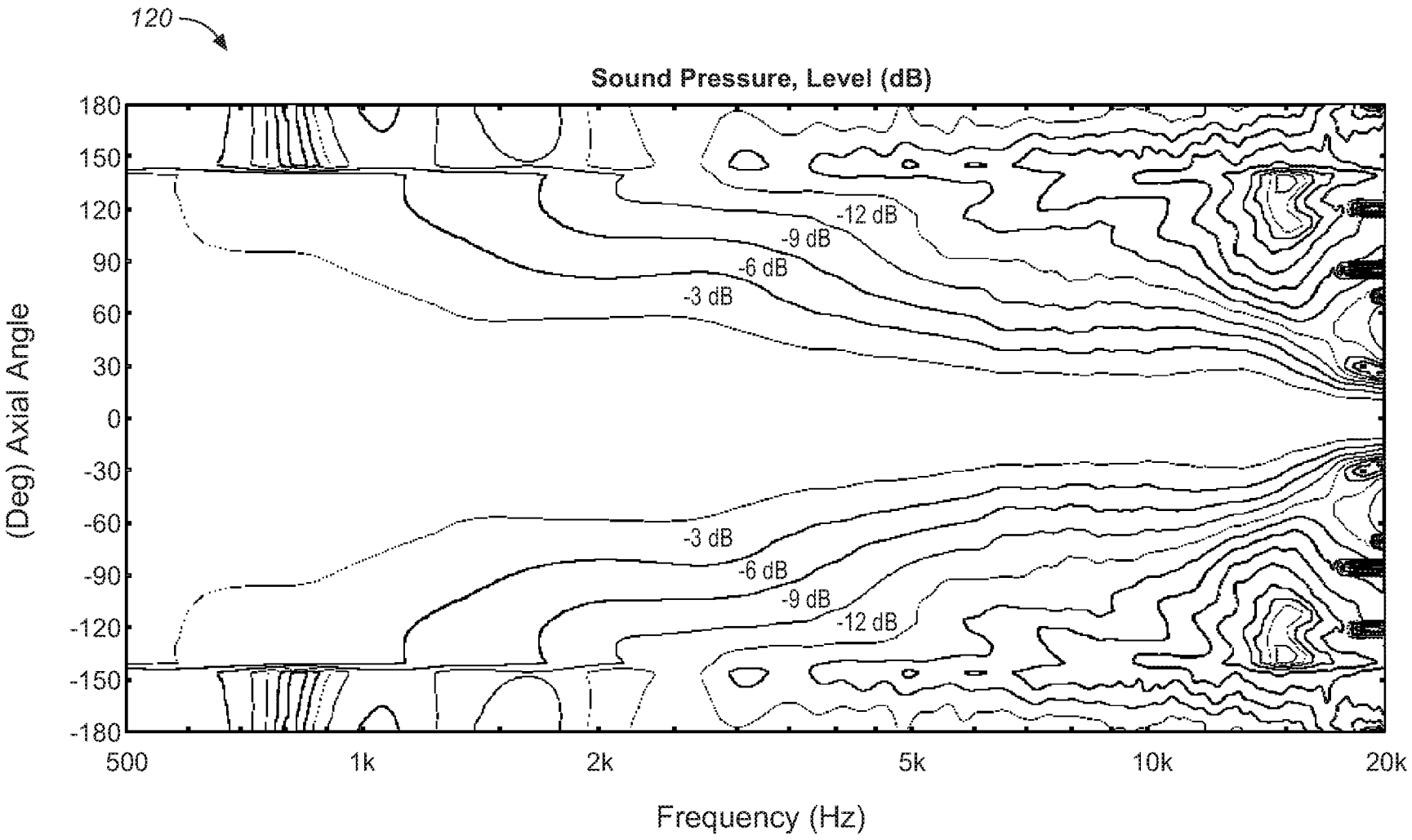
FIG. 1E (PRIOR ART)
FIG. 1E shows an example horizontal dispersion pattern for a 120 mm planar magnetic loudspeaker with ±45 degree horizontal waveguides.
Figure 1F:
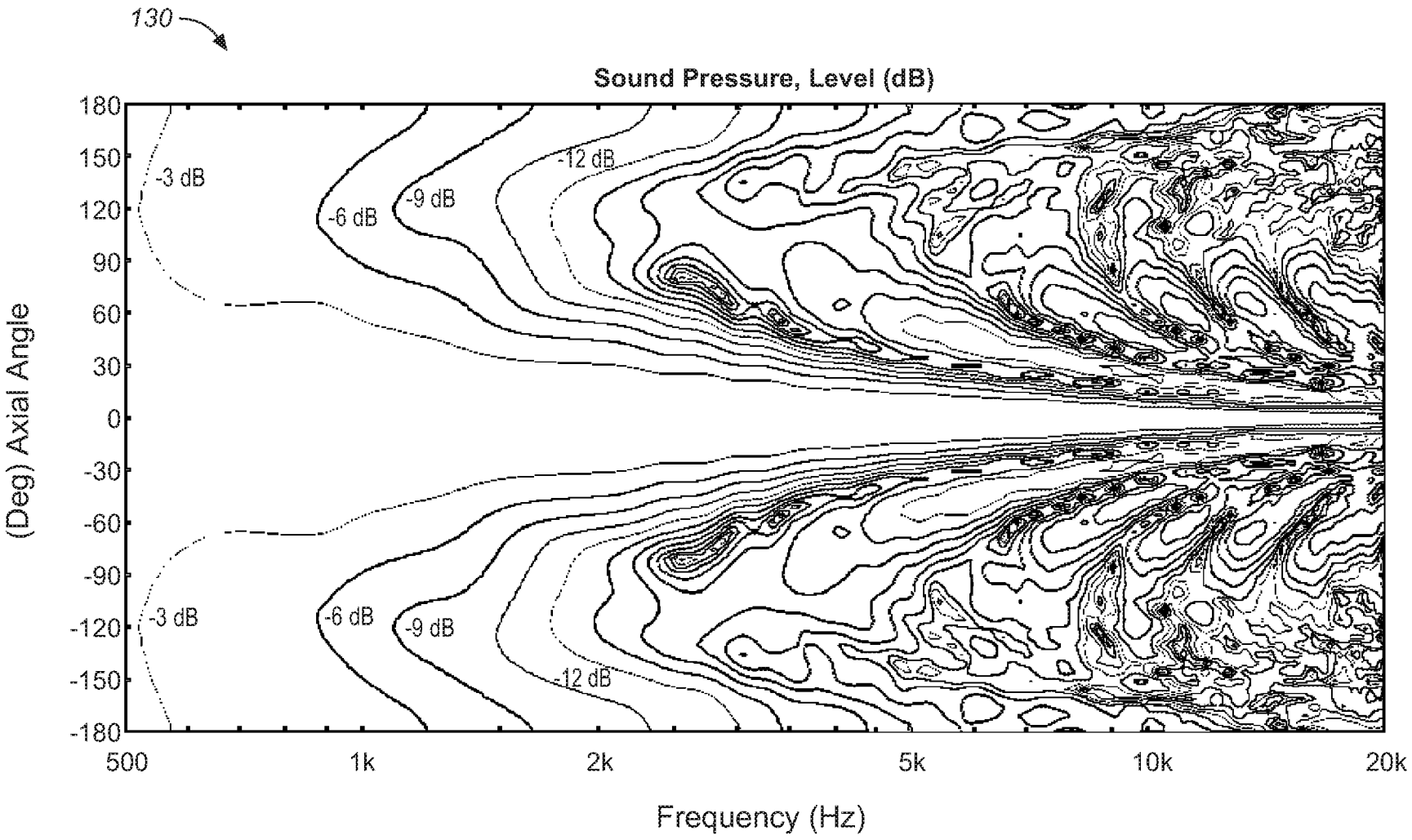
FIG. 1F (PRIOR ART)
FIG. 1F shows an example vertical dispersion pattern for a 120 mm planar magnetic loudspeaker.

Dipole planar magnetic drivers are similar to the those described in FIGS. 1A and 1B, except that their cases are open at rear as well as the front. A manifold as described above could therefore be used on the rear of the planar magnetic driver to alter the rear dispersion. The rear manifold could be the same as the front manifold, or it could be different to the front manifold so as to independently control the front and rear dispersion. For example where a front manifold could have a 90 degree horizontal and 30 degree vertical dispersion characteristic to direct sound to an audience area, the rear manifold could have a wider 120 degree horizontal and 90 degree vertical dispersion characteristic to create greater perception of diffuse sound behind the loudspeaker. In another example, the rear manifold could be designed to reflect rear sound off the ceiling to accentuate the perception of diffusion.

The construction materials for the manifold and any associated speaker cabinets may be tailored depending on system requirements, and many different configurations and sizes are possible. For example, in an embodiment, the cabinet may be made of medium-density fiberboard (MDF), or other material, such as wood, fiberglass, Perspex, and so on; and it may be made of any appropriate thickness, such as 0.75" (19.05 mm) for MDF cabinets.

Aspects of the systems described herein may be implemented in an appropriate computer-based sound processing network environment for processing digital or digitized audio files. Portions of the audio system may include one or more networks that comprise any desired number of individual machines.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A planar magnetic loudspeaker system having a substantially planar driver, a case surrounding the driver and having two case openings aligned with a long axis of the driver, and an apparatus for altering a sound wavefront shape from the planar driver, said apparatus comprising:

a mounting surface attached to a front surface of the case and having two openings matching said case openings to allow sound from the driver to project therethrough; and a waveguide portion coupled to the mounting surface and having a structure configured to channel sound projected from the driver through the two openings to be combined in one output area, wherein the structure has a plurality of reflective surfaces configured to create output sound that has a consistent dispersion pattern over a defined area, said reflective surfaces being formed from contours formed into said side walls to form sound transmission paths for any sound channeled through the two openings, wherein the side walls are curved inward to form a narrower sound transmission area around a center of the loudspeaker and a wider sound transmission area around opposite ends of the loudspeaker, and wherein the one output area comprises an outwardly flared sound output area forming a dispersion angle along a short axis of the loudspeaker of approximately 90 degrees.

2. The system of claim 1 wherein the structure comprises a manifold frame with two side walls and a central pillar running between the side walls to form said two openings and said one output area, and wherein said reflective surfaces are further formed into corresponding projections formed into said central pillar.

3. The system of claim 2 wherein the one output area comprises an outwardly angled waveguide, the angled waveguide comprising a compound flared structure having a series of flared openings each waveguide angles increased at each additional flaring element.

4. The system of claim 1 wherein the manifold structure is configured to increase at least one of a long-axis beamwidth or short-axis beamwidth of the projected sound so that listeners positioned off an axis of the loudspeaker will hear a wide range of frequencies at a substantially similar sound level, the range of frequencies comprising approximately 200 Hz to 20 kHz.

5. The system of claim 4 wherein a dispersion pattern of the output sound is one of:

symmetric about both the long axis and short axis of the loudspeaker or asymmetric about either or both of the long axis and short axis of the loudspeaker.

6. The system of claim 1 wherein the planar magnetic driver is a dipole planar magnetic driver configured to radiate sound through openings on opposite sides of the case, and wherein a manifold frame is coupled to each opposite side, and wherein a manifold frame coupled to one side is the same or different from the manifold frame coupled to the opposite side.

7. A method of increasing one or more dispersion angles of a planar magnetic loudspeaker having a substantially planar driver projecting sound through a case having two separate openings along the long axis of the driver, the method comprising:

directing the sound projected from the two openings into two entry columns of an acoustic manifold attached to a front surface of the case, said manifold having a frame structures to form two sound transmission paths;

channeling the sound through said two transmission paths of the two entry columns to combine and form a single sound output;

wherein the side walls are curved inward to form a narrower sound transmission area around a center of the loudspeaker and a wider sound transmission area around opposite ends of the loudspeaker; and projecting the single sound output through a flared output area to create output sound that has a consistent dispersion pattern over a defined area, and having a dispersion angle of approximately 90 degrees.

8. The method of claim 7, wherein the frame structures comprise two side walls and a central pillar running between the side walls to form said two entry columns and one output area, and reflective surfaces being formed from contours formed into said side walls and corresponding projections formed into said central pillar.

9. The method of claim 8 wherein the flared output area comprises an outwardly angled waveguide forming a dispersion angle along a short axis of the loudspeaker, and comprising a compound flared structure having a series of flared openings each waveguide angles increased at each additional flaring element.

10. The method of claim 7 wherein the manifold structure is configured to increase at least one of a long-axis beamwidth or short-axis beamwidth of the projected sound so that listeners positioned off an axis of the loudspeaker will hear a wide range of frequencies at a substantially similar sound level, the range of frequencies comprising approximately 200 Hz to 20 kHz.

11. The method of claim 10 wherein a dispersion pattern of the output sound is one of symmetric about both the long axis or short axis of the loudspeaker, and wherein the driver is one of a monopole speaker or a dipole speaker.

* * * * *